United States Patent [19]

Hasegawa

[11] Patent Number: 4,619,250

[45] **Date of Patent: * Oct. 28, 1986**

[54] THERAPEUTIC APPLIANCE FOR IMPROVING FUNCTIONS OF HAND FINGERS

[75] Inventor: Tsuneo Hasegawa, Tokyo, Japan

[73] Assignee: Man Design Co., Ltd., Tokyo, Japan

[ * ] Notice: The portion of the term of this patent subsequent to Jun. 11, 2002 has been disclaimed.

[21] Appl. No.: 660,046

[22] Filed: Oct. 12, 1984

[30] Foreign Application Priority Data

Oct. 14, 1983 [JP] Japan ..... 58-192254

[51] Int. Cl.[4] ..... A61H 1/02

[52] U.S. Cl. ..... 128/26; 128/DIG. 20; 84/465

[58] Field of Search ..... 128/25 R, 26, 77, DIG. 20; 84/465

[56] References Cited

U.S. PATENT DOCUMENTS

| | | | |
|---|---|---|---|
| 3,581,740 | 6/1971 | Sherbourne | 128/77 |
| 3,937,215 | 2/1976 | Barthlome | 128/26 |
| 4,274,399 | 6/1981 | Mummert | 128/26 |
| 4,522,197 | 6/1985 | Hasegawa | 128/26 |

FOREIGN PATENT DOCUMENTS

| | | | |
|---|---|---|---|
| 735700 | 6/1966 | Canada | 128/DIG. 20 |

*Primary Examiner*—Richard J. Apley
*Assistant Examiner*—David J. Brown
*Attorney, Agent, or Firm*—Birch, Stewart, Kolasch & Birch

[57] ABSTRACT

A therapeutic appliance for improving the functions of an individual's carpal joints, hand and fingers includes a palm splint cloth shaped so as to accommodate a hand with its fingers spread apart. Finger retainer members are disposed on the front surface of the splint cloth for holding the fingers individually in their spread apart positions. A plurality of first bladders are disposed on the front surface of said palm splint cloth and positioned between each adjacent fingers except between the thumb and forefinger in a palmiped configuration for spreading the fingers apart form each other. A plurality of second bladders are disposed on the opposite surface of said palm splint cloth for extending the fingers, hand and the carpal joint and fluid supply and discharge tubes are connected to the first and second bladders for supplying and discharging fluid to and from the bladders. By supplying fluid simultaneously to all of the bladders or selectively to any selected one or more of the bladders through the tubes and discharging the fluid from the bladders through the tubes after a predetermined period of time which may be repeated, imparts extending and opening motions to the functionally incapacitated carpal joint, hand and fingers forcedly, rythmically and intermittently to thereby remedy the bending contracture and dysfunction in extending motion as well as to create a motive for triggering self-motivating capacity.

7 Claims, 3 Drawing Figures

THERAPEUTIC APPLIANCE FOR IMPROVING FUNCTIONS OF HAND FINGERS

BACKGROUND OF THE INVENTION

1. Field of the Invention

This invention relates to a therapeutic appliance for aiding in recovering the functions of carpal joints, hand and fingers incapacitated due to diseases or impediments in the central nervous system such as cerebrovascular troubles, cerebral injury, cerebral palsy and spinal damage as well as impediments in the peripheral nervous system, joints, muscles, and tendons.

SUMMARY AND OBJECT OF THE INVENTION

In the event that the forearm, carpal joints, hands and fingers are functionally disordered due to the foregoing diseases and impediments, it is required to conduct exercise for recovering mobility concurrently with medical treatment. However, it has been heretofore recognized very difficult to recover the functions of incapacitated carpal joints, hands and fingers. Satisfactory solution to this problem has not yet been reached for all research in the modern rehabilitative medicine. No satisfactory result has been achieved in restoring the extensibility of carpal joints, hand and fingers inflicted with bending contracture or dysfunction in extending motion with the aid of air pressure or springs for example.

Recognizing that the prior art therapeutic gloves have been incapable of aiding in adequately extending the carpal joints, hands and fingers because of insufficiency in the effect of the air pressure or spring forces and of inducing self-motion, the present invention contemplates positively spreading the fingers apart and positively straightening the carpal joints, hands and fingers by applying air pressure to the carpal joints, hands and fingers intermittently, sustainedly and positively in a rational manner, whereby not only the dysfunction in such extending motion is remedied, but also the plasticity of the function and the compensatory function of the nervous system are promoted to create a motive for triggering the self-motion of the carpal joints, hands and fingers.

BRIEF DESCRIPTION OF THE DRAWINGS

This invention will now be described in details with reference to embodiments illustrated in the accompanying drawings in which.

DETAILED DESCRIPTION OF THE PREFERRED EMBODIMENT

Figure 1:
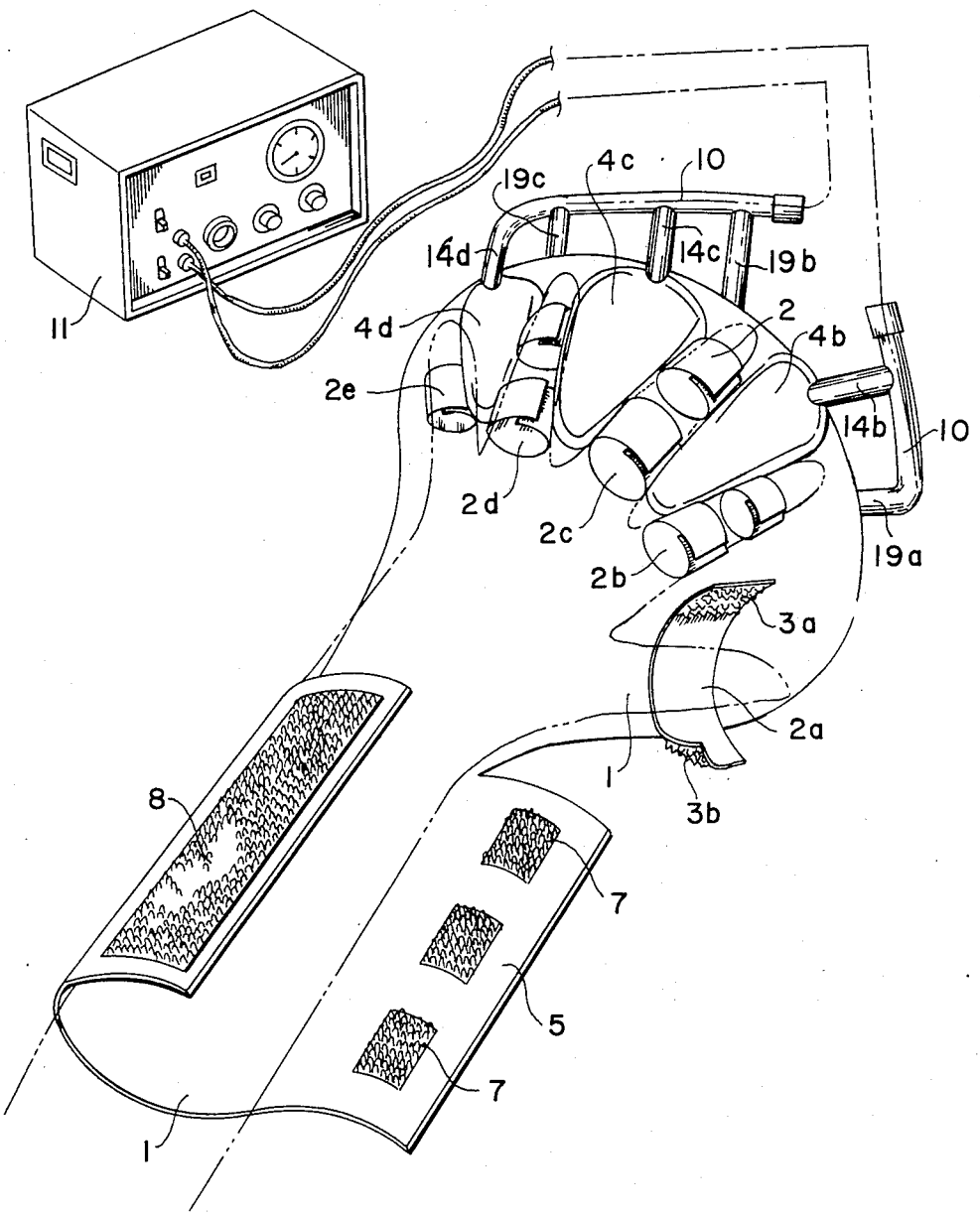
FIG. 1 is a perspective view illustrating a therapeutic appliance according to one embodiment of this invention in use.
Figure 2:
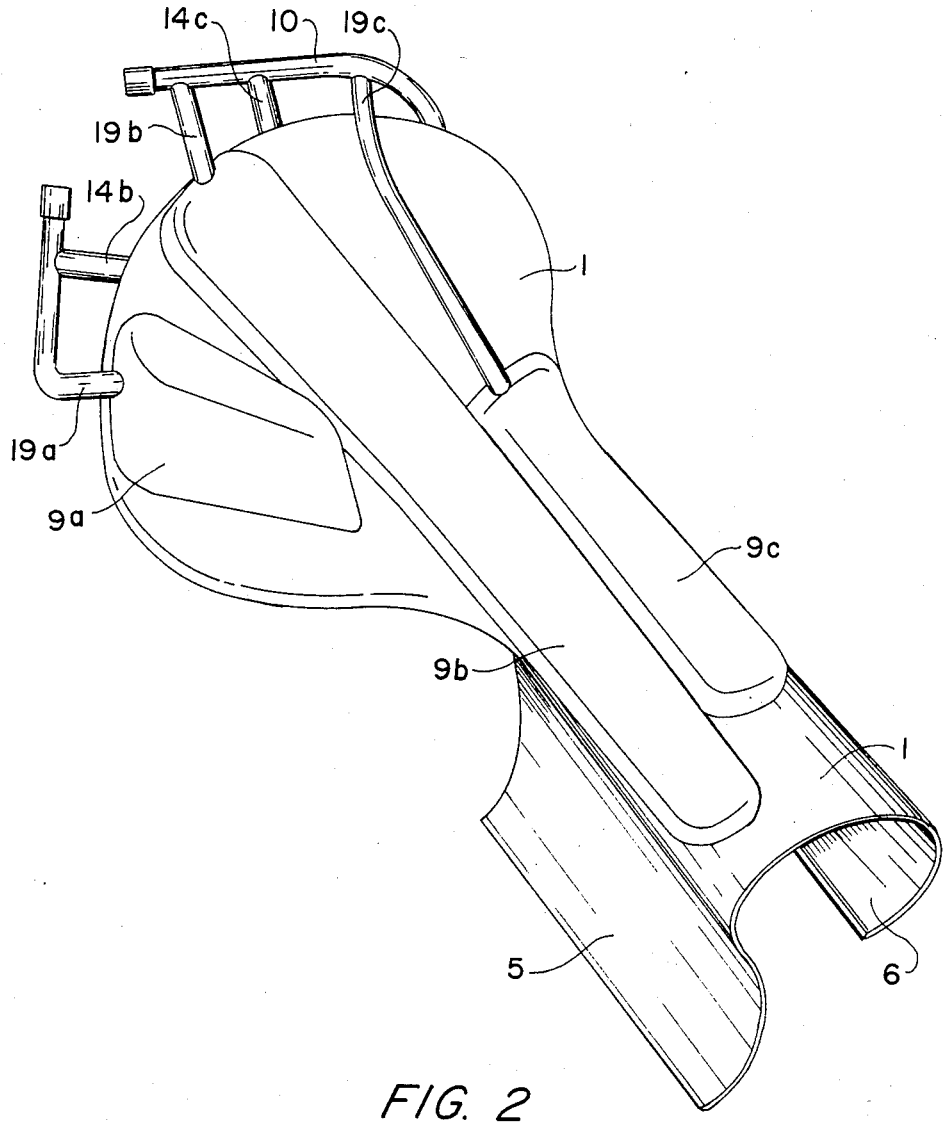
FIG. 2 is a perspective view of the therapeutic appliance as viewed from the palm side.

Referring to FIGS. 1 and 2, a splint cloth is generally designated by 1 which is shaped so as to accommodate the entire palm of a standard size hand of a healthy person with its fingers spread apart and has a length sufficient to extend over the forearm. The splint cloth 1 is made of pliable and agreeable-to-the-touch material such as fabric, synthetic resin sheet or the like.

The splint cloth 1 is provided adjacent its forward end with finger retainer means 2*a*, 2*b*, 2*c*, 2*d* and 2*e* for holding the five fingers individually in their spread apart position. As shown in FIG. 1, each of the finger retainer means 2*a*–2*e* may be provided at its opposed ends with a hooking element 3*a* and a mating looping element 3*b* of a "Velcro" fastener to be tied up into a loop.

Figure 3:
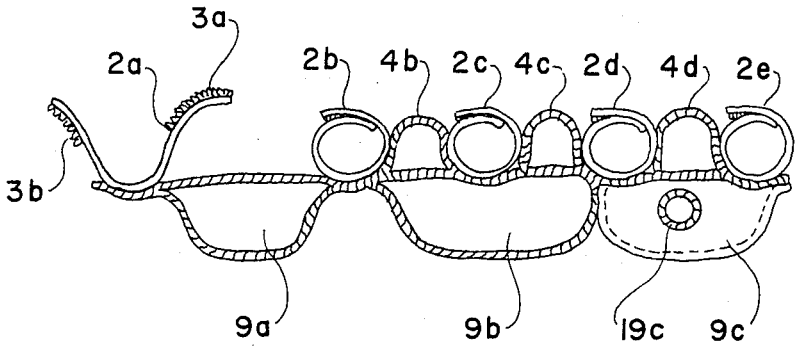
FIG. 3 is a sectional view of the appliance as taken transversely through the finger retainer means.

The splint cloth 1 further includes paddle-like bladders 4*b*, 4*c* and 4*d* for spreading the four fingers apart from each other except for the space between the thumb and forefinger. As shown in FIGS. 1 and 3, these bladders are positioned between the finger retainer means 2*b*, 2*c*, 2*d* and 2*e* corresponding to the forefinger, middle finger, third finger and little finger, respectively in their spread apart positions.

The splint cloth 1 has a pair of fastening flaps 5, 6 extending from the forearm splint cloth portion 1' thereof adapted to embrace the wrist and forearm. Attached to the fastening flaps 5, 6 are a hooking element 7 and a mating looping element 8, respectively of a Velcro type fastener.

The splint cloth 1 further includes inflatable air bladders 9*a*, 9*b* and 9*c* disposed longitudinally on the back side of the splint cloth 1 opposite from the side on which the air bladders 4*b*, 4*c*, 4*d* are disposed. The bladders 9*a*, 9*b*, 9*c* are adapted be inflated and deflated by supply and discharge of compressed air thereto and therefrom. As seen in FIG. 3, the bladder 9*a* is positioned between the thumb retainer means 2*a* and forefinger retainer means 2*b*, the bladder 9*b* spans the middle finger retainer 2*c* and the two bladders 4*b*, 4*c* and extends longitudinally to and over the forearm splint cloth position 1', and the bladder 9*c* extends from the forearm splint cloth portion 1' to and over the carpal joint splint cloth portion so as to span the third finger and little finger retainer means 2*d* and 2*e* and the bladder 4*d*, but not so far as to excessively extend the little finger.

A pair of air supply and discharge headers 10 are provided to connect the bladders 4*b*, 9*a* and bladders 4*c*, 4*d* and 9*b*, 9*c* with a source 11 of compressed air and adapted to supply compressed air simultaneously into the bladders 4*b*, 4*c*, 4*d* and 9*a*, 9*b*, 9*c* and discharge the air simultaneously from those bladders. When it is desired to suply compressed air selectively into the bladders 4*b*, 4*c*, 4*d*, 9*a*, 9*b*, 9*c*, one or more of branch tubes 14*b*, 14*c*, 14*d*, 19*a*, 19*b* and 19*c* leading into the bladder or bladders which need not be supplied with compressed air may be closed to interrupt the supply of compressed air by pinching the tube or tubes by a clip (not shown).

The operation of the appliance according to the illustrated embodiment of this application will be described below.

Prior to applying the therapeutic appliance to the functionally incapacitated hand fingers and arm, the finger retaner means 2*a*, 2*b*, 2*c*, 2*d*, 2*e* disposed on the face of the splint 1 and the arm fastening flaps 5 and 6 are opened. The face of the splint cloth 1 is applied to the palm of the deformed or contracted hand and the finger retainers 2*a*, 2*b*, 2*c*, 2*d*, 2*e* are wrapped around the corresponding five fingers. The hooking element 3*a* of the Velcro fastener at the free end of each of the finger retainer is then pressed into engagement with the mating looping element 3*b*. The fastening flaps 5 and 6 are wrapped around the forearm and the hooking element 7 of the Velcro fastener is pressed against the looping element 8. Thus; the five fingers and forearm are held in place by the finger retainers 2*a*, 2*b*, 2*c*, 2*d*, 2*e* and the fastening flaps 5, 6, respectively. With the fingers and forearm held in place, the compressed air source 11 is operated to introduce compressed air at a predetermined pressure through the headers 10 and branch tubes 14*b*, 14*c*, 14*d*, 19*a*, 19*b*, 19*c* into the interdigital bladders 4*b*, 4*c*, 4*d* and the bladders 9*a*, 9*b*, 9*c* on the palm side to inflate all the bladders whereby the forefinger, middle finger, third finger and little finger are laterally spread apart from each other while at the same time the fingers and thumb are extended to the extent that the hand is bent backwards. In this way the fundamental movements such as extending of the carpal joint and extending and spreading apart of the fingers are forcedly effected.

Then, when the air is allowed to or forced to be discharged from the interdigital bladders 4*b*, 4*c*, 4*d* and the palm side bladders 9*a*, 9*b*, 9*c*, the hand fingers are restored to their original positions. This cyclic operation will impart repeated spreading and extending motions to the hand fingers.

The method of using the appliance described above is intended to extend and open up the hand, fingers and carpal joint to remedy the bent contracture and dysfunction in extending motion by inflating and deflating all of the bladders 4*b*, 4*c*, 4*d*, 9*a*, 9*b*, 9*c*. However, in the case that the bending contracture or dysfunction in extending and flexing motion has not extended to all of the carpal joint, hand and hand fingers, any one or more of the air supply tubes leading to unnecessary bladders may be closed as by the use of a pinch clip to selectively remedy the affected parts only.

When the treatment is completed, the hooking element 7 of the fastening flap 5 is removed from the looping element 8 and the finger retainers 2*a*, 2*b*, 2*c*, 2*d*, 2*e* are released, whereby the therapeutic appliance may be easily removed from the hand fingers and arm.

The embodiment of this invention has been described hereinabove. It is to be appreciated that the present invention provides a therapeutic appliance for improving the functions of hand fingers and others comprising: a palm splint cloth shaped so as to accommodate a hand with its fingers spread apart, finger retainer means disposed on the front surface of the splint cloth for holding the fingers individually in their spread apart positions, a plurality of first bladders disposed on the front surface of the splint cloth and positioned between each adjacent fingers except between the thumb and forefinger in a palmiped configuration for spreading the fingers apart from each other, a plurality of second bladders disposed on the opposite surface of said palm splint cloth for extending the fingers, hand and the carpal joint, and air supply and discharge tubes connected to said first and second bladders for supplying and discharging compressed air to and from the bladders, whereby operations of supplying compressed air simultaneously to all of the bladders or selectively to any selected one or more of the bladders through said tubes and discharging the air from the bladders through the tubes after a predetermined period of time may be repeated to impart extending and opening up motions to the functionally incapacitated carpal joint, hand and hand fingers forcedly, rythmically and intermittently to thereby remedy the bending contracture and dysfunction in extending motion as well as to create a motive for triggering self-motivating capacity. Rythmical and intermittent stimuli sustainedly imparted to all or parts of the affected carpal joint, hand and fingers by extending and opening up the same with the present therapeutic appliance applied to them will be transmitted through the sensory nerves to the sensory and perceptive system of the nerve center and thence through the nervous tissues in the nerve center to the motor system to induce and promote the plasticity and compensatory function of the nervous system whereby the voluntary motions at the treated locations may be developed and promoted to improve the functions.

It is thus to be understood that the therapeutic appliance according to the present invention is capable of positively spreading apart the fingers as well as adequately extending the fingers, hand and carpal joint, in contrast to the conventional therapeutic gloves utilizing pneumatic pressure or springs. Further, this invention is capable of effecting intermittent and sustained forced movements of the fingers, hand and carpal joint in a rational and proper manner by rythmical and intermittent changes in air pressure. Moreover, it is capable of effecting discrete forced movements compatible to the function of the carpal joint.

The use of easily engageable and releasable Velcro type fasteners for the finger retainer means as in the illustrated embodiment permits the appliance to be readily applied to the hand and fingers inflicted heavy bending contracture. Accordingly, the appliance of this invention is very easy to use and easy to be removed from the patient's hand after the use, regardless of the degree of bending contracture of the carpal joint, hand and fingers.

What is claimed is:

1. A therapeutic appliance for improving the functions of an individual's carpal joints, hands and fingers comprising;

a splint cloth including a palm splint cloth shaped so as to accommodate a palm with its fingers spread apart and a forearm splint cloth extending from the palm splint cloth so as to cover the carpal joint and at least a portion of the forearm;

finger retainer means disposed on a front surface of the splint cloth for holding the fingers individually in their spread apart positions;

a plurality of first bladders disposed on the front surface of said palm splint cloth and positioned between each adjacent fingers except between the thumb and forefinger in a palmiped configuration for spreading the fingers apart from each other;

a plurality of second bladders disposed on the opposite surface of said palm splint cloth for extending the fingers, hand and the carpal joint; and fluid supply and discharge tubes connected to said first and second bladders for supplying and discharging fluid to and from the bladders;

whereby operations of supplying fluid simultaneously to all of the bladders or selectively to any selected one or more of the bladders through said tubes and discharging the fluid from the bladders through the tubes after a predetermined period of time may be repeated to impart extending and opening motions to the functionally incapacitated carpal joint, hand and fingers forcedly, rythmically and intermittently to thereby remedy the bending contracture and dysfunction in extending motion as well as to create a motive for triggering self-motivating capacity.

2. A therapeutic appliance according to claim 1, wherein the fluid is compressed air.

3. A therapeutic appliance according to claim 1, wherein said palm splint cloth includes a forearm splint cloth with fastening flaps for securing said forearm splint cloth to an individual's forearm.

4. A therapeutic appliance according to claim 1, wherein each of said plurality of first bladders is substantially triangular in shape with the apex of the triangle being positioned at a joint between each finger.

5. A therapeutic appliance according to claim 1, wherein said finger retaining means are looping strips having ends connected to the front side of the palm splint cloth and free opposite ends including "Velcro" fasteners for securing an individual's fingers to said palm splint cloth.

6. A method of improving the functions of an individual's carpal joints, hands and fingers comprising the following steps:

retaining an individual's palm and forearm on a splint cloth with the fingers spread apart;

positioning bladders on a first side of the splint cloth between each adjacent finger except between the thumb and forefinger;

positioning bladders on an opposite side of said splint cloth for extending the fingers, hand and carpal joint;

supplying fluid sumultaneously to all of the bladders or selectively to any selected one or more of the bladders for imparting extending and opening motions to the carpal joint, hand and fingers forcedly, rythmically and intermittently for remedying bending contracture and dysfunction in extending motion as well as to create a motive for triggering self-motivating capacity.

7. A therapeutic appliance for improving the functions of an individual's carpal joints, hands and fingers comprising:

a splint cloth including a palm splint cloth shaped so as to accommodate a palm with its fingers spread apart and a forearm splint cloth extending from the palm splint cloth so as to cover the carpal joint and at least a portion of the forearm;

at least one finger retainer means for each of the five fngers disposed on a front surface of the palm splint cloth for holding the fingers individually in their spread apart positions, each of said finger retainer means comprising looping strip means connected to the front surface of the palm splint cloth and having free opposite ends carrying "Velcro fasteners" for releasably securing the corresponding finger to said palm splint cloth;

fastening flaps on said forearm splint cloth for releasably securing the forearm to the forearm splint cloth;

a plurality of first bladders disposed on the front surface of said palm splint cloth and positioned between each adjacent fingers except between the thumb and forefinger in a palmiped configuration for spreading the fingers apart from each other;

a plurality of second bladders disposed on the opposite surface of said palm splint cloth for extending the fingers, hand and the carpal joint; and fluid supply and discharge tubes connected to said first and second bladders for supplying and discharging fluid to and from the bladders;

whereby operations of supplying fluid simultaneously to all of the bladders or selectively to any selected one or more of the bladders through said tubes and discharging the fluid from the bladders through the tubes after a predetermined period of time may be repeated to impart extending and opening motions to the functionally incapacitated carpal joint, hand and fingers forcedly, rythmically and intermittently to thereby remedy the bending contracture and dysfunction in extending motion as well as to create a motive for triggering self-motivation capacity.

* * * * *